US006846201B2

(12) United States Patent
Lazaro, Jr.

(10) Patent No.: US 6,846,201 B2
(45) Date of Patent: Jan. 25, 2005

(54) ELECTRICAL CABLE CLAMPING METHOD AND APPARATUS

(75) Inventor: Luis J. Lazaro, Jr., Shoreline, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/323,750

(22) Filed: Dec. 20, 2002

(65) Prior Publication Data

US 2004/0121650 A1 Jun. 24, 2004

(51) Int. Cl.[7] ..... H01R 13/40
(52) U.S. Cl. ..... 439/598; 439/609; 439/610
(58) Field of Search ..... 439/609, 610, 439/598, 98–99, 274, 578, 582–583

(56) References Cited

U.S. PATENT DOCUMENTS 3,609,632 A * 9/1971 Vetter ..... 439/258
3,646,496 A * 2/1972 Williams ..... 439/462
5,151,053 A * 9/1992 Shinji et al. ..... 439/610
5,580,278 A * 12/1996 Fowler et al. ..... 439/609
5,895,291 A * 4/1999 Furio et al. ..... 439/610
6,116,955 A * 9/2000 Lazaro, Jr. ..... 439/610
6,146,204 A * 11/2000 Lazaro, Jr. ..... 439/609
6,276,967 B1 * 8/2001 Hall ..... 439/610
6,339,193 B1 * 1/2002 Goett et al. ..... 174/78
6,406,329 B1 * 6/2002 Lazaro, Jr. ..... 439/598
6,514,104 B1 * 2/2003 Lazaro, Jr. ..... 439/609

* cited by examiner

*Primary Examiner*—Michael C. Zarroli
(74) *Attorney, Agent, or Firm*—Baker & Hostetler LLP

(57) ABSTRACT

A strain relief, modular, self-aligning, corrosion resistant, highly conductive, environmentally sealing cable clamp or "backshell" has a female adapter having a coupling ring at its proximal end which is connected to a rotatable flexible tubing with a split saddle clamp at is distal end and a male adapter which can be a ground or EMI/RFI adapter. This cable clamp, or "backshell", ensures full engagement on the interfacing accessory teeth, "backshell" and connector, and resistive to environmental hazards, maintains electrical/electronic shielding integrity, improve mechanical reliability and provides form factor capability.

31 Claims, 6 Drawing Sheets

ELECTRICAL CABLE CLAMPING METHOD AND APPARATUS

FIELD OF THE INVENTION

This invention relates generally to the field of connection devices for electrical shielded cables and the like. In particular, it relates to a modular, self-aligning, corrosion resistant, highly conductive strain relief cable clamp sometimes referred to as a "backshell".

BACKGROUND OF THE INVENTION

The invention pertains to a cable clamp that combines performance, user-friendly assembly and installation, standardization and reusability. There are several important considerations in the designing of such a cable clamp. First, the "backshell" can be used as a strain relief device (providing mechanical support) and/or as an EMI/RFI grounding device (providing electrical connection) or both in the assembly of electrical shielded cable. Second, the performance attributes of a cable clamp such as its coupling mechanism, corrosion resistivity, conductivity properties and usage application should preferably be maximized at least to some extent while the related assembly tools and operator skill/learning attributes should be minimized at least to some extent. Another desirable feature would be the provision of an environmental sealing capability which would prevent ingress of contaminants, fluid or grime or otherwise, onto the electrical connector. In particular, cable clamps installed in applications such as aircraft my be subject to fluids such as fuel, cleaning fluid, lubricating fluid, deicing fluid, hydraulic fluid, water and other substances not desired to contact electrical connections.

While prior art cable clamp mechanisms have been industry accepted, several deficiencies and disadvantages exist. For example, ground shield termination using lugs and a commonly accepted method called "banding" to terminate electrical cable individual and overall shields requires laborious, error-prone, non-reusable assembly. Another is the plating finish used to protect the "backshell" from corrosion inducing contaminant such as hydraulic, aviation, de-icing fluids, and other contaminants while retaining its electrical conductivity requirement. Also, the cost associated with customized cable clamps, to be either straight or angular due to its installation usage, can be significant.

Previous designs can also be somewhat complicated at the point of assembly, where multiple cables need to be grounded. Care must be taken to properly connect each cable and to ensure a proper electrical connection. Accordingly, a cable clamp that is easily connected to cables through standard electrical connections such as pigtail connections is desired.

Some known designs may further not lend themselves to maintenance by being disassembled and then reassembled. Many known designs, in fact, are meant to be assembled only once and must be replaced if they are opened for maintenance. Accordingly, a cable clamp which lends is self to assembly and disassembly for maintenance and repair is desired.

Other disadvantages with known clamp designs include a reduced ability to seal the electrical connector from foreign substances. Accordingly, it is desirable to provide a clamp that provides a sealing member to the electrical connector from foreign substances.

It would also be desirable to use a similar "backshell" male member, split compression ring and a wrap-around band as described, in U.S. Pat. No. 6,406,329.

Thus, it would be desirable to have a cable clamp whose attributes and functionality are designed to enhance efficiency with regard to its coupling methodology, corrosion resistivity, conductivity, assembly, usage, sealing protection, tooling, installation and reusuability.

SUMMARY OF THE INVENTION

In one aspect, the invention provides an electrical connector strain relief cable clamp which has desirable characteristics in its coupling methodology, corrosion resistivity, conductivity, assembly, usage, sealing protection, tooling, installation and reusability. The clamp is modularly constructed, is self-aligning, has selective finishes and environmental sealing protection. The cable clamp has a female adapter with a threaded, self-seating or self-locking coupling ring at its proximal end connected to a rotatable, temperature flexible tubing having a split saddle clamp at its distal end, and a male adapter with a conductive finish. The male adapter can be a ground adapter having accessory teeth on its proximal end and with a plurality of electrical contact retention clips embedded around the peripheral area of its termination platform; and assembled onto it is a corrosion resistant seal compression ring strategically placed forward of its accessory teeth. Alternatively the male adapter can be an EMI/RFI adapter having accessory teeth on its proximal end and a pre-spaced slotted distal end around its periphery. Assembled onto the adapter is a corrosion resistant seal compression ring strategically placed forward of its accessory teeth. Included to be used with the EMI/RFI adapter are a split compression ring and a wrap-around band as described in U.S. Pat. No. 6,406,329.

It is another feature of the invention to provide a strain relief cable clamp that in some embodiments takes advantage of the properties, improvements and novelties described in U.S. Pat. No. 6,406,329.

A further feature of the invention is to enable a standard strain relief cable clamp where the form factor or routing installation, either straight or angular, is met.

A still further feature of the invention is providing a strain relief cable clamp with selective finish or plating where both corrosion resistant and electrically conductive properties are achieved without compromising one or the other.

It is also a feature and advantage of the present invention to provide a clamp that provides a sealing member to the electrical connector from foreign substances. It is another feature and advantage of the present invention to provide a clamp that is reusable and capable of being opened for maintenance or other working and then resealed. It is another feature and advantage of the present invention to provide a clamp with a flexible tubing attached, therefore enabling the clamp to be used in different environments where either a straight, curved, or angular clamp is required.

The above and other features and advantages are achieved through the use of a novel method for clamping wires and a clamp as herein disclosed. In one further aspect the invention provides a cable clamp comprising: a first corrosion resistant backshell member, and a second electrically conductive backshell member configured to accommodate at least one of a wire end and a cable termination end to provide grounding, wherein said first and second backshell members attach to each other and said first backshell member substantially contains said second backshell member when said backshell members are connected to the electrical connector.

In another further aspect, the invention provides a cable clamp comprising: electrically conductive means for grounding at least one of a wire end and a cable termination end to provide grounding, and corrosion resistant means for surrounding the grounding means, wherein said surrounding means attached to said grounding means and provides substantial corrosion protection to said grounding means when the clamp is connected to the electrical connector.

In accordance with another aspect of the present invention, a method of grounding an electrical system is provided. The method comprises: engaging a first backshell member to an electrical connector via teeth located on the first backshell member and the connector, grounding at least one of a shield cable to the first backshell member, covering the first backshell member with a second backshell member, and attaching the second backshell member to the electrical connector and fully shielding the first backshell member within a space defined, at least in part, by the second backshell member and the electrical connector.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
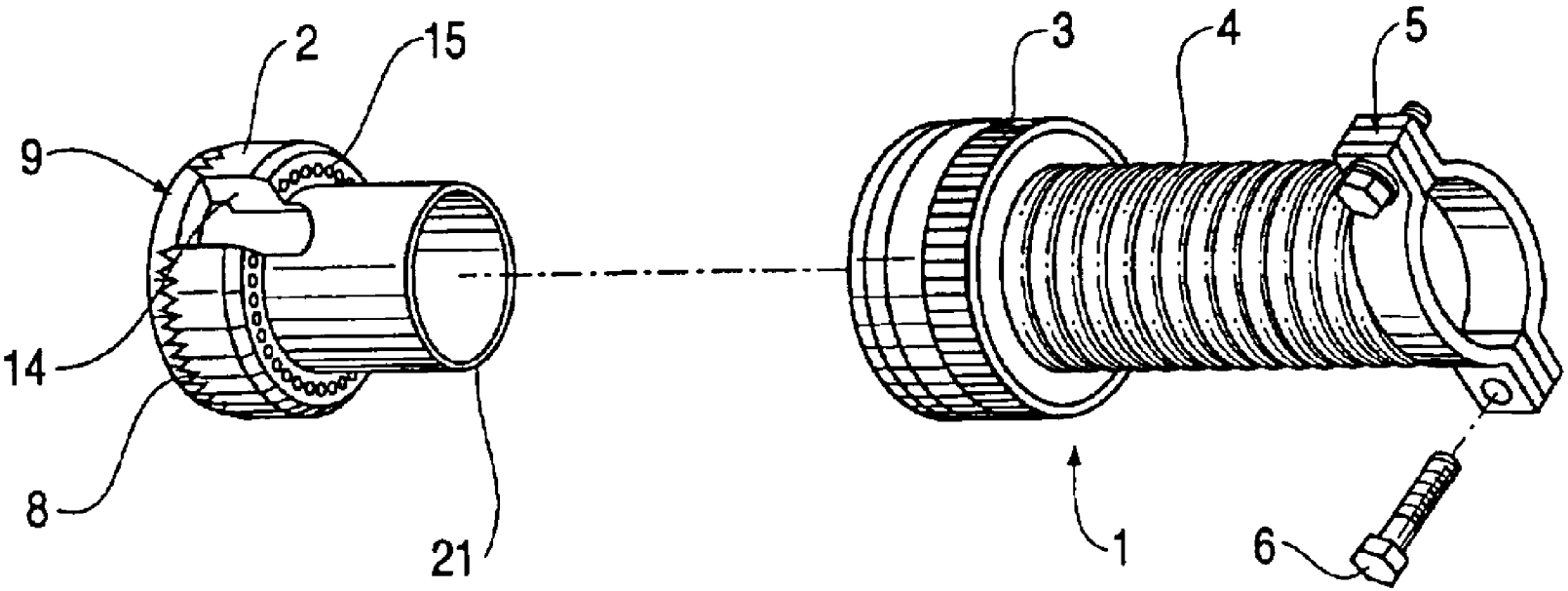
FIG. 1 is an exploded perspective view of one embodiment of the present invention, illustrating a strain relief cable clamp or "backshell" having a female adapter with a coupling ring on its proximal end connected to a flexible tubing and a first type of male adapter with accessory teeth in the form of a ground adapter having a plurality of electrical contact retention clips embedded around the peripheral area of its termination area and a corrosion resistant seal compression ring, where the tubing portion of the female adapter is in a straight position.

A preferred embodiment of the present invention in the form of a cable clamp, sometimes referred to as a "backshell", is shown in FIGS. 1–6, wherein like reference numerals indicate like elements. The cable clamp described herein is in some aspects similar to the cable clamp described in U.S. Pat. No. 6,406,329 which is hereby incorporated herein by reference in its entirety.

This strain relief cable clamp is modular in construction and comprises a female adapter 1 and a male adapter 2 or 2A. The females adapter 1 has a (having a coupling ring 3 with a self-seating or self-locking anti-coupling device (not shown) such as is known in the prior art) connected to a rotatable, graded temperature flexible tubing 4 attached to a split saddle clamp 5 at its distal end. The saddle clamp 5 uses hex-head screws 6 and clinch nuts 7 for ease of assembly. In the embodiment of the invention shown in FIG. 1, the flexible tubing 4 is shown in a straight position, however, the tubing 4 may be configured in a multitude of positions to accommodate installation of the clamp in a variety of locations. Examples of different tubing positions are shown in FIGS. 2 and 4.

Figure 2:
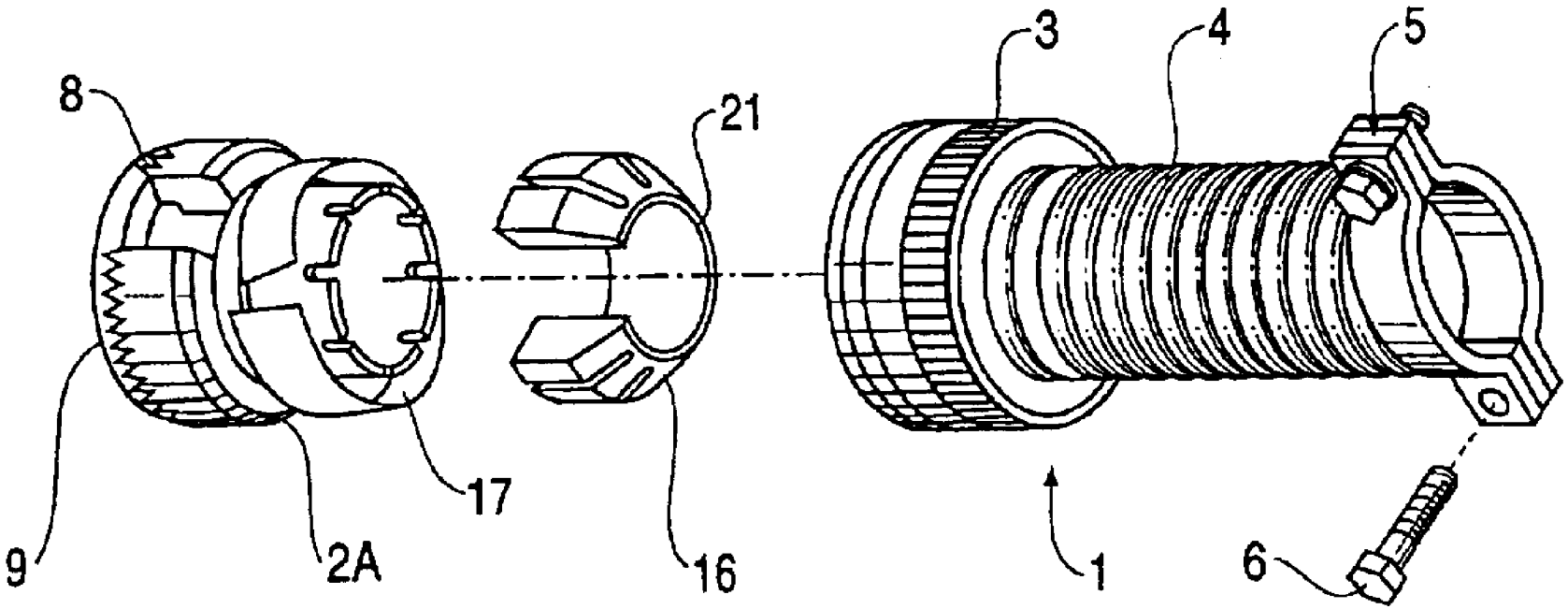
FIG. 2 is an exploded perspective view of one embodiment of the present invention similar to FIG. 1, but where the male adapter is an EMI/RFI adapter having a slotted distal end and a wrap-around band and split compression ring.
Figure 3:
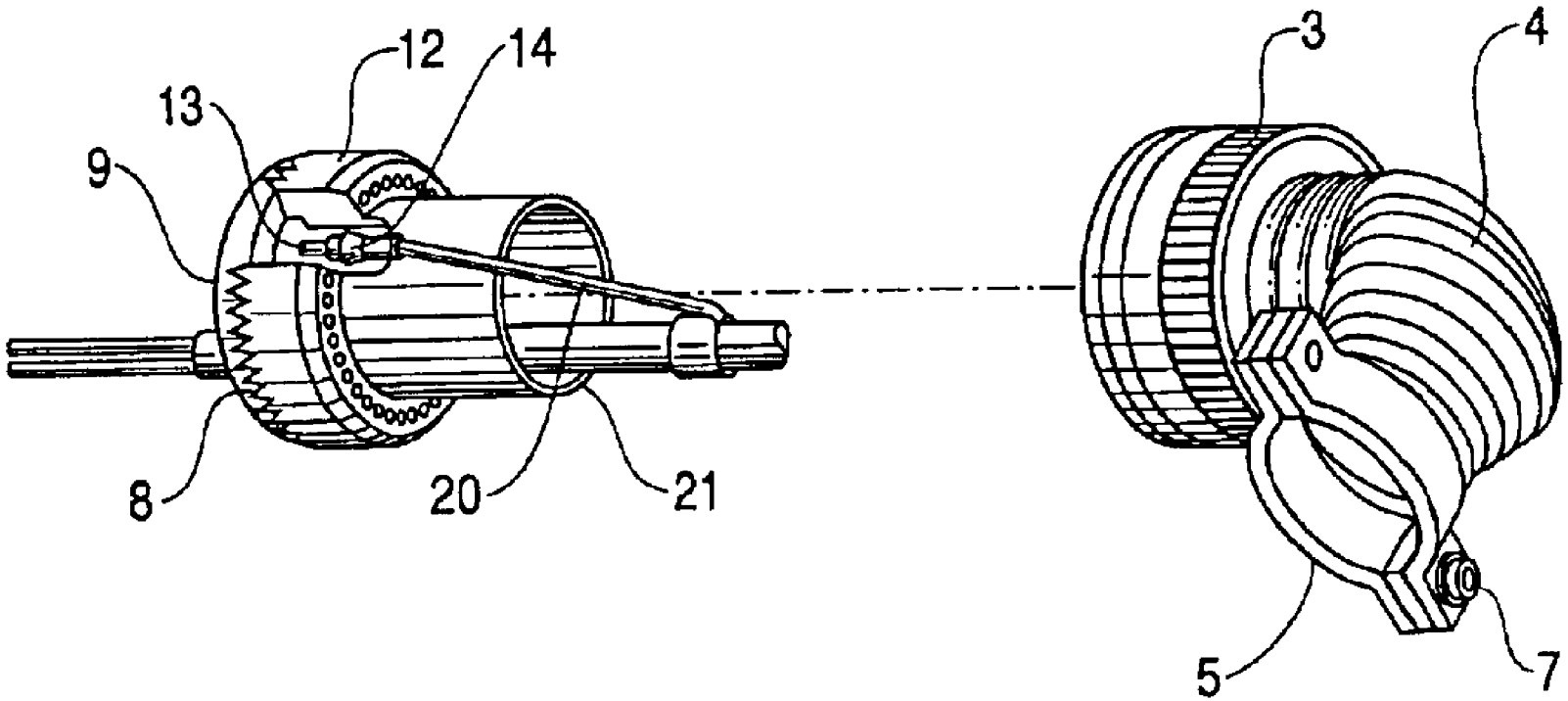
FIG. 3 is an exploded perspective view of the embodiment of FIG. 1, where the tubing portion of the female adapter is in a bent position and showing the wire and/or cable shield termination.
Figure 4:
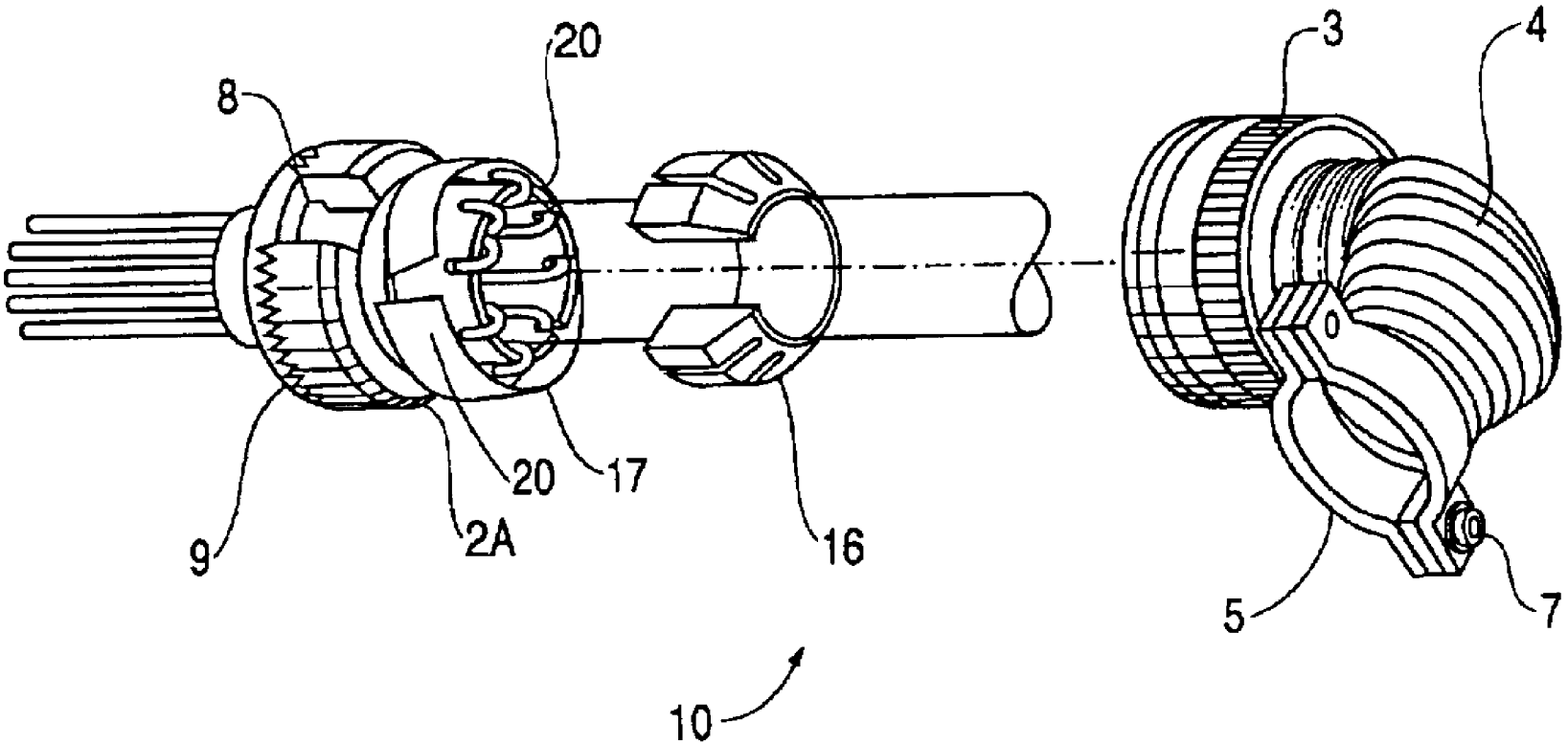
FIG. 4 is an exploded perspective view of the embodiment of FIG. 2, where the tubing portion of the female adapter is in a bent position and showing the wire and/or able shield termination.

The other main component of the exemplary "backshell" is a male adapter 2 or 2A in the form of either a ground adapter 2 as seen in FIGS. 1 and 3 or an EMI/RFI adapter 2A as seen in FIGS. 2 and 4. The adapter 2 or 2A has accessory teeth 8, a seal compression ring 9 and an electrically conductive finish such as by plating. The functionality of the cable, such as an airplane system requirement, circuit grounding and/or noise filtering determines the selection of the type of male adapter 2 or 2A.

To better understand the overall assembly, the assembly of this strain relief cable clamp can be simply described as the female adapter 1 engaging the male adapter 2 or 2A under compressive load. The coupling ring 3 on the female adapter 1 is coated with a corrosion resistant finish such as black anodized. The female adapter 1 has a different finish than the male adapter 2 or 2A. Having such selective finishes provides the ability to withstand harsh environmental condition and associated fluids such as hydraulic, lubricating, fuel, anti-deicing, cleaning, and the like, while retaining the backshell's desirable conductivity property.

Figure 5:
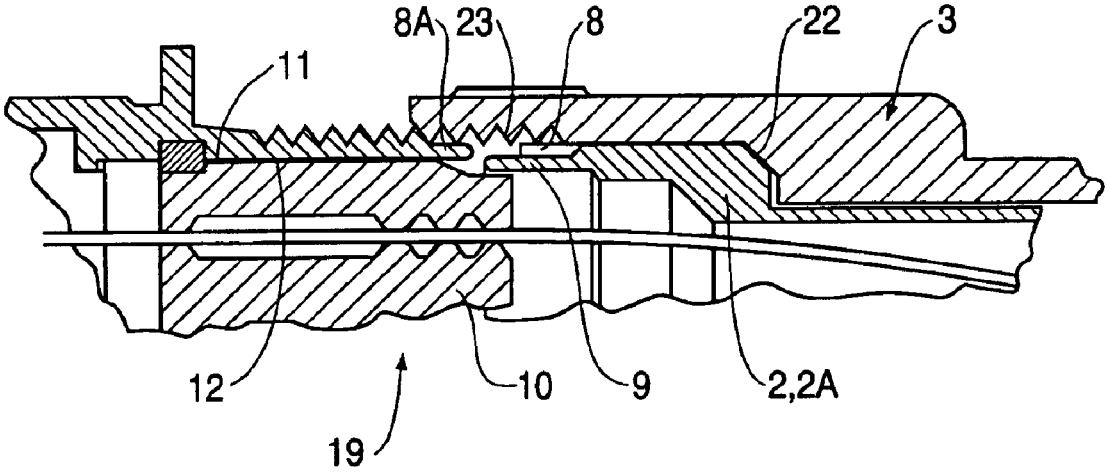
FIG. 5 is a cut away side sectional view of an embodiment of the invention with an electrical connector being coupled to the present invention strain relief cable clamp, illustrating the seal compression ring forming a seal around the cavity of the connector grommet and shell.
Figure 6:
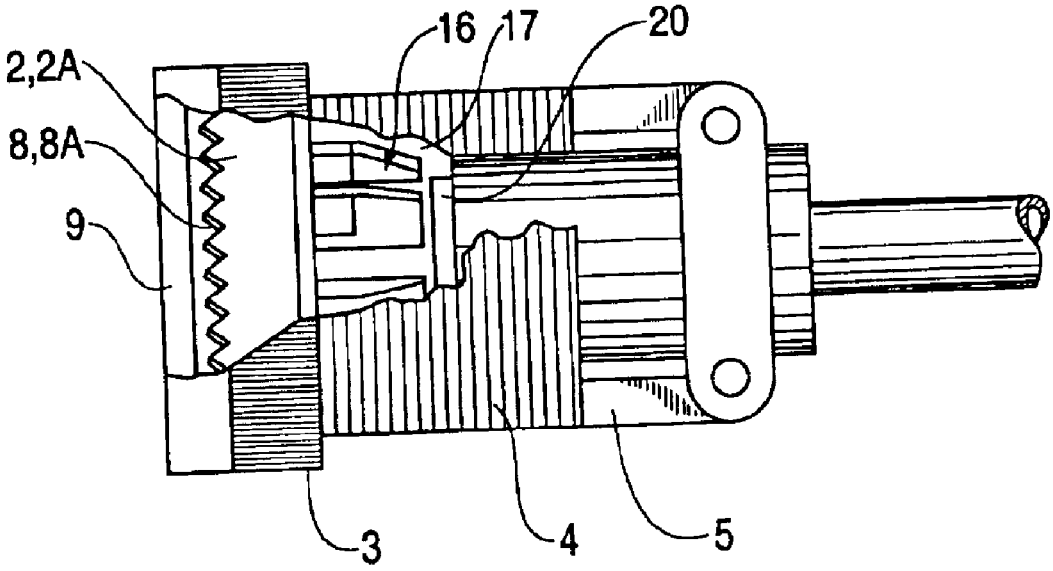
FIG. 6 is a cut away side elevation view of an embodiment of the present invention, with the backshell assembled onto the electrical connector, a portion thereof being broken away to show the electrical junction formed by the interfitting metallic shell, housing and coupling parts all joined together with the terminated overall ground shields shown.

The coupling ring 3 of the female adapter 1 shields the male adapter 2 or 2A from any outside exposure as shown in FIGS. 5 and 6. Having these selective finishes enables the desirable capabilities of high corrosion resistivity and conductivity. Some embodiments also have a seal compression ring 9, shown in FIG. 5 whose function is to wedge into the cavity between connector grommet 10 and shell 11 thereby preventing any ingress of contaminant, fluid, grime or combination therefore, which degrade the bond 12 on the grommet 10 and shell 11, creating a path that causes electrical arcing or shorts. The seal compression ring 9 has a corrosion resistant finish.

As described above, the present invention uses either of two types of males adapters. A first type of adapter is a ground adapter 2 that uses the conventional shield pigtail lug termination. It also uses a standard M39029/58 size 22 pin contact 13 installed or inserted in a retention clip 14. There is an array of retention clips 14 embedded around the peripheral area of the adapter termination area 15. Also, included is the seal compression ring 9 as described above. The second type of male adapter is an EMI/RFI adapter 2A used in the individual and/or overall wire and cable shield termination. The male adapter 2A is similar to the adapter described in U.S. Pat. No. 6,406,329 and its usage with a split compression ring 16 and wrap around band 17 is as described in that patent. The assembly of the present invention eliminates the prior art self seating or self-locking problematic blind coupling which results from non-engagement on the interface accessory teeth 8 and 8A. That is, engagement or non-engagement of the accessory teeth 8 and 8A between the backshell and the electrical connector 19 is a by product of the anti-coupling device in the coupling ring 3. It is understood that during coupling when accessory teeth 8 and 8A are at a peak-to-peak condition then it will cause "binding", creating a scenario of a false coupling of the backshell and connector 19. A prior art solution to this problem is to look through an inspection hole in the backshell and then rock the backshell back and forth to dislodge the accessory teeth 8 and 8A from the peak-to-peak condition. This process might be repeated several times until accessory teeth 8 and 8A are fully engaged. This process is sometimes laborious, tedius and failure prone. In some exemplary embodiments of the invention, the male adapter 2 or 2A is simply dropped into position, meaning, the accessory teeth 8 and 8A are fully engaged prior to the coupling ring 3 of female adapter 1 being threadedly coupled to the connector 19. This assembly assures full engagement between the accessory teeth 8 and 8A.

As shown in FIGS. 1 and 3, the wire and cable shield 20 terminated onto the ground adapter 2 is inserted and can be removed when necessary, which provides the inventive backshell easy assembly and repairability/retrievability, compared to prior art shield pigtail termination using lugs (not shown) which is not amenable to repair or retermination without replacement of the shield pigtails. Also, in the prior art, rework on the connector 19 involves laborious disassembly of the shield pigtails from the backshell saddle clamp 5.

FIGS. 2 and 4 illustrate an exemplary embodiment having the EMI/RFI adapter 20A, which is further described in U.S. Pat. No. 6,406,329.

As will now be apparent, when the female adapter 1 and electrical connector 19 are connected, the engaging ends 21 on the male adapter 2 or 2A will be under compressive force from the tapered inner periphery or shoulder 22 located behind the internal thread 23 on the female adapter 1. This condition forms a joint between the wire and cable shield 20 and the connector 19. Also in place is the seal compression ring 9.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A cable clamp for connecting to a connector, comprising:

a first corrosion resistant backshell member; and a second electrically conductive backshell member configured to accommodate at least one of a wire end and a cable termination end to provide grounding, wherein said first and second backshell members attach to each other and said first backshell member contains said second backshell member when said backshell members are connected to an electrical connector.

2. The clamp of claim 1, further comprising flexible tubing attached to said first backshell member.

3. The clamp of claim 2, further comprising a split saddle clamp attached to said flexible tubing for clamping said flexible tubing to a support structure.

4. The clamp of claim 1, further comprising a seal compression ring configured to substantially seal a connection between said second backshell member and the connector.

5. The clamp of claim 1, wherein said second backshell member has axially facing accessory teeth configured to interface with the connector accessory teeth to provide a secure mechanical and an electrical connection between said second backshell member and said connector.

6. The clamp of claim 1, wherein said second backshell member is configured to provide grounding for at least one pigtail cable end.

7. The clamp of claim 6, further comprising at least one cable termination end for attaching the pigtail cable end and accommodation feature on said electrically conductive backshell member.

8. The clamp of claim 1, further comprising:

a split compression ring; and a wrap around band, wherein when said first and second backshell members are threadedly connected, said split compression ring compresses said wrap around band to compress at least one cable termination end to the second backshell member to create an electrical connection between each termination end and said second backshell member.

9. A method of grounding an electrical system comprising the steps of:

engaging a second backshell to a connector via axially facing accessory teeth located on the second backshell and the connector;

grounding at least one of a cable end to the second backshell;

covering the second backshell with a first backshell; and attaching the first backshell to the connector so that the second backshell is fully encapsulated within a space defined by the first backshell and the connector.

10. The method of claim 9, further comprising:

attaching a flexible tube to the first backshell;

attaching a split saddle clamp on the said tube; and securing said flexible tube by clamping to the support structure.

11. The method of claim 10, further comprising flexing the flexible tube to fit routing or installation in the system.

12. The method of claim 9, further comprising protecting a bond between the connector shell and grommet by wedging a compression ring in the cavity formed in between said connector shell and grommet.

13. The method of claim 9, wherein the grounding step includes providing an electrical connection between a pigtail connection and the second backshell.

14. A strain relief cable clamp, wherein the cable clamp is modularly constructed, is self-aligning, has corrosion resistant exterior finishes and conductive interior finishes, and environmentally sealing protection comprising:

a female adapter having at its proximal end a coupling ring with internal thread said coupling ring connected to a flexible tubing with a split saddle clamp at its distal end, and said coupling ring having a corrosion resistant finish and having a configured inner surface or shoulder located behind said internal thread; and a male adapter having interfacing accessory teeth, a seal compression ring and conductive finish, wherein said male and female adapters attach to each other and said female adapter encapsulates said male adapter when said male and female adapters are connected to an electrical connector.

15. The clamp of claim 14, wherein said male adapter is a ground adapter with a plurality of electrical contact retention clips embedded around the peripheral area of its termination platform; and a corrosion resistant seal compression ring assembled onto and placed forward of said accessory teeth.

16. The clamp of claim 15, wherein said male adapter is an EMI/RFI adapter having a pre-spaced slotted distal and around its periphery, accessory teeth on its proximal end and a compression ring located forward of said accessory teeth.

17. The clamp of claim 16, wherein said male adapter is used with a wrap-around band and split compression ring.

18. The clamp of claim 14, where the male adapter is under compressive load when the female adapter is coupled onto an electrical connector.

19. The clamp of claim 14, comprising an interfitting metallic shell, housing and coupling parts for forming an electrical conductive path with cable shields to neutralize lightning strike and/or EMI/RFI interference.

20. The clamp of claim 14, wherein said female adapter shields said male adapter from environmental contamination.

21. The clamp of claim 19, wherein said male adapter has a modular construction that allows the male adapter to fully engage an electrical connector without influence from an anti-coupling device on the coupling ring.

22. The clamp of claim 20, wherein whereby interfacing accessory teeth on the cable clamp and electrical connector provide an electrical conductive path and mechanical strength.

23. The clamp of claim 19, wherein the female adapter has a corrosion resistant finish and the male adapter has an electrically conductive finish.

24. The clamp of claim 22, wherein the strain relief cable clamp can be exposed to environmental hazards without degradation of its resistance and transfer impedance properties.

25. The clamp of claim 17, wherein the seal compression ring is pushed in the cavity of the electrical connector grommet and shell.

26. The clamp of claim 22, wherein the seal compression ring provides environmental protection to a bonding of the electrical connector grommet onto its shell.

27. The clamp of claim 22, wherein usage of the flexible tubing allows required form factor or routing installation of wire bundle or cable assembly to be met.

28. A circular connector rear accessory for shielded cable, comprising:

a contact fitting having a distal rim and receptacles for electrical contact pins;

a rear accessory body that entirely envelopes said contact fitting, said rear accessory body further comprising a female-threaded proximal section and an inner tapered section that tapers to be smaller in diameter in the direction away from the connector; and a tapered pressure insert that mates with said inner tapered section.

29. The circular connector rear accessory of claim 28, wherein said contact fitting has a conductive finish.

30. The circular connector rear accessory of claim 28, wherein said contact fitting further comprises a plurality of axially facing teeth that mate with axially facing accessory teeth on the connector body.

31. The clamp of claim 28, wherein said rear accessory body shields said contact fitting from environmental contamination.

* * * * *